US009180474B2

(12) United States Patent
Jokitalo et al.

(10) Patent No.: US 9,180,474 B2
(45) Date of Patent: Nov. 10, 2015

(54) DISPENSING MECHANISM AND A DISPENSER

(71) Applicant: SCA HYGIENE PRODUCTS AB, Goteborg (SE)

(72) Inventors: Joonas Jokitalo, Borlange (SE); Marcus Kullman, Borlange (SE); Erik Hjort, Borlange (SE)

(73) Assignee: SCA HYGIENE PRODUCTS AB, Göteborg (SE)

( * ) Notice: Subject to any disclaimer, the term of this patent is extended or adjusted under 35 U.S.C. 154(b) by 0 days.

(21) Appl. No.: 14/026,298

(22) Filed: Sep. 13, 2013

(65) Prior Publication Data

US 2014/0027473 A1 Jan. 30, 2014

Related U.S. Application Data

(63) Continuation of application No. PCT/SE2011/050276, filed on Mar. 14, 2011.

(51) Int. Cl.

| | |
|---|---|
| ***B65D 37/00*** | (2006.01) |
| ***B05B 11/00*** | (2006.01) |
| ***A47K 5/12*** | (2006.01) |
| ***B65D 35/40*** | (2006.01) |
| *B65D 83/00* | (2006.01) |

(52) U.S. Cl.

CPC ..... *B05B 11/3056* (2013.01); *A47K 5/1208* (2013.01); *B05B 11/303* (2013.01); *B65D 35/40* (2013.01); *B65D 83/0055* (2013.01)

(58) Field of Classification Search

CPC ..... G01F 11/088; F16K 11/027; F16K 7/063; A61M 39/284; A61M 39/285; A61M 39/28; A61M 39/286; A47K 5/1208; A47K 5/12; B65D 35/40; B65D 35/38; B65D 83/201; B65D 83/207; B65D 83/206; B65D 35/24; B65D 83/0055; F04B 43/1246; F04B 43/1253; B05B 11/3032; B05B 11/3028; B05B 11/3015; B05B 11/3029; B05B 11/303; B05B 11/3056

USPC ..... 222/207, 209, 212–215, 287, 103, 222/181.3, 402.15, 469, 470, 472, 473, 490, 222/491, 494, 508, 95, 505; 251/4, 6, 9

See application file for complete search history.

(56) References Cited

U.S. PATENT DOCUMENTS

| | | | | |
|---|---|---|---|---|
| 2,113,022 | A * | 4/1938 | Hefti | 222/207 |
| 3,741,439 | A | 6/1973 | Vehrs | |

(Continued)

FOREIGN PATENT DOCUMENTS

| | | | |
|---|---|---|---|
| EP | 0336953 | A1 | 10/1989 |
| WO | WO-2011/133077 | A1 | 10/2011 |

OTHER PUBLICATIONS

Extended European Search Report dated Aug. 27, 2014 issued in corresponding European patent application No. 11860887.6.

*Primary Examiner* — Frederick C Nicolas
*Assistant Examiner* — Bob Zadeh
(74) *Attorney, Agent, or Firm* — Drinker Biddle & Reath LLP

(57) ABSTRACT

A dispensing mechanism for a liquid container is arranged in liquid communication with an outlet mechanism. The dispensing mechanism is adapted to translate a user force applied to a user operated portion into a transfer force applied from a user lever to an actuation part. A relationship between a first length and a second length forms a lever ratio. The first length extends from a first pivot axis to a user operated portion and the second length extends from the first pivot axis to a point of action of the transfer force on the actuation part. The lever ratio is adapted to increase from a non-actuated position over at least the first 50% of a dispensing stroke of the actuation part such that the transfer force increases over the at least first 50% of the dispensing stroke when a constant force is applied to the user operated portion.

20 Claims, 8 Drawing Sheets

(56) References Cited

U.S. PATENT DOCUMENTS 3,881,641 A * 5/1975 Pliml et al. ..... 222/207
4,570,829 A * 2/1986 Allen ..... 222/207
4,715,517 A * 12/1987 Potter et al. ..... 222/181.2
5,042,691 A 8/1991 Maldonado
6,068,162 A 5/2000 De Winter et al.
6,540,110 B2 * 4/2003 Weiser ..... 222/103

* cited by examiner

DISPENSING MECHANISM AND A DISPENSER

CROSS-REFERENCE TO PRIOR APPLICATION

This application is a Continuation Application of PCT International Application No. PCT/SE2011/050276 filed Mar. 14, 2011, which is incorporated herein in its entirety.

TECHNICAL FIELD

The present disclosure relates to a dispensing mechanism for a liquid container arranged in liquid communication with an outlet mechanism for a liquid, and a dispenser including such a dispensing mechanism.

BACKGROUND

Dispensing apparatuses for liquids in which the apparatus includes a container for the liquid and is provided with, or connected to, an outlet mechanism in the form of a flexible dispensing part are commonly used for dispensing such diverse liquids as for instance liquid soap, foam soap, alcogel, disinfecting or anti bacterial liquid, and lotion. The flexible dispensing part is filled with the relevant liquid and subjected to an external force in order to dispense the liquid therefrom. A user may apply a force on the flexible dispensing part directly or indirectly. The flexible dispensing part may be of such a size that a suitable or desired volume, e.g. 1 milliliter, of the liquid is dispensed upon complete actuation of the flexible dispensing part. An alternative outlet mechanism of a dispensing apparatus may include a pump mechanism including a fixed pump part and a movable pump part. The movable pump part is slidably engaged with the fixed pump part.

U.S. Pat. No. 3,741,439 discloses a viscous liquid dispenser suitable for dispensing contents of collapsible tubes. An elastic tubing portion is connected to the collapsible tube and affected by a dispensing mechanism including two levers, a dispensing lever and a movable lever, in order to dispense liquid from the elastic tubing portion. The dispensing lever has two arms, a lower arm and an upper arm, each one on a respective side of a fulcrum. The movable lever has its fulcrum at one end thereof. The upper arm of the dispensing lever bears against a shim on the movable lever such that, during a dispensing stroke of the dispensing lever, the upper arm moves along the shim towards the fulcrum of the movable lever. The lower arm of the dispensing lever is subjected to a force by a user to perform a dispensing stroke when viscous liquid is to be dispensed. During the dispensing stroke, the dispensing lever rotates about its fulcrum and the upper arm presses against the shim of the movable lever. Since the lower arm of the dispensing lever is longer than the upper arm, a force increasing leverage is achieved between the force applied by the user and a force by means of which the upper arm presses against the shim of the movable lever. However, during the dispensing stroke, the upper arm moves along the shim of the movable lever and a leverage of the movable lever decrease from a maximum value at the beginning of the dispensing stroke. Accordingly, a user must apply an increasing force as the dispensing stroke progresses to achieve the full dispensing stroke.

U.S. Pat. No. 6,540,110 discloses an apparatus for dispensing a free-flowing product in a bag. By means of a squeezing device, a user may dispense a portion of the free-flowing product from an apportioning chamber of the bag. The squeezing device includes an abutment wall, against which the apportionment chamber abuts, and hand-actuated pressure-exerting parts, including a hand lever and a pressure-exerting pivoting part. The pressure-exerting pivot part clamps the bag in the region of the apportioning chamber and squeezes free flowing product therefrom upon a user actuating the hand lever. The leverage between the hand lever and the pressure-exerting pivot part appears to be substantially fixed over the dispensing stroke of the hand lever.

International patent application PCT/SE2010/050446 discloses an outlet mechanism for dispensing foam. A liquid container includes a liquid reservoir and a foam pump. A nozzle cap is arranged to at least partly enclose the foam pump. The nozzle cap includes a first end surface. The nozzle cap is displaceable in a first direction so as to activate the foam pump in the first direction. The first end surface of the nozzle cap includes a dispensing opening aligned with the foam pump through which a quantity of the liquid in the form of a foam is discharged upon activation of the foam pump.

A complete actuation of an outlet mechanism for dispensing liquid may be difficult to achieve. Some dispensing mechanisms require a user to apply an increasing force to achieve such complete actuation. Thus, it may be difficult to dispense a desired volume of liquid.

SUMMARY

It is desired to provide a dispensing mechanism which will allow a user to easily dispense a liquid from an outlet mechanism of a liquid container or an outlet mechanism of a dispensing apparatus.

According to an aspect, a dispensing mechanism for a liquid container is arranged in liquid communication with an outlet mechanism for a liquid. The dispensing mechanism including:

a movable actuation part including a contact surface adapted to abut against the outlet mechanism, and a user lever arranged to pivot about a first pivot axis and including a user operated portion.

The dispensing mechanism is adapted to translate a user force applied to the user operated portion into a transfer force applied from the user lever to the actuation part. A relationship between a first length and a second length forms a lever ratio. The first length extends from the first pivot axis to the user operated portion and the second length extends from the first pivot axis to a point of action of the transfer force on the actuation part. The lever ratio is adapted to increase from a non-actuated position over at least the first 50% of a dispensing stroke of the actuation part such that the transfer force increases over the at least first 50% of the dispensing stroke when a constant force is applied to the user operated portion.

Since the leverage ratio between the first length and the second length increases over at least half the dispensing stroke, a constant user force applied to the user lever will result in an increased force being applied to the outlet mechanism from the contact surface of the first lever. Expressed differently, a user force required in order to subject the actuation part to a dispensing stroke will decrease from a first initial level over at least half the dispensing stroke of the actuation part. As a result, the dispensing mechanism allows a user to easily dispense a liquid from an outlet mechanism of a liquid container or an outlet mechanism of a dispensing apparatus. This applies to the dispensing mechanism as such. In practice, characteristics of the outlet mechanism affect the user force. Naturally, the increasing leverage ratio has a positive effect also in practice.

The liquid container may be adapted to be filled with a liquid such as for instance liquid soap, foam soap, alcogel, disinfecting or anti-bacterial liquid, or lotion. The outlet mechanism may be formed in several different ways as long as it, by means of the liquid communication with the container, is adapted to be filled with the relevant liquid and when subjected to an external force, is adapted to dispense the liquid from the outlet mechanism. The outlet mechanism may be of such a size that a suitable or desired volume, e.g. 1 milliliter, of the liquid may be dispensed upon performing a full dispensing stroke. In case foam soap is dispensed from a relevant dispenser, liquid soap from the container may be mixed, for instance in the outlet mechanism, with air to produce a dispensed foam.

According to embodiments, the transfer force may be directed along a transfer force direction. The transfer force direction may extend through a centre of rotation associated with the actuation part and about which centre of rotation the transfer force direction may rotate as the dispensing stroke progresses.

According to embodiments, the user lever may include a first sliding surface and the actuation part may include a second sliding surface. The first and second sliding surfaces may bear in sliding abutment against each other at an abutment point. The abutment point may constitute the point of action for conveying the transfer force from the user lever via the first sliding surface to the second sliding surface and the actuation part. In this manner, the transfer force is transferred from the user lever to the actuation part via the first and second sliding surfaces abutting against each other. Since the first and second sliding surfaces bear in sliding abutment against each other, the abutment point moves along the sliding surfaces as a dispensing stroke progresses.

According to embodiments, the second sliding surface may be convex. In this manner, the transfer force and the transfer force direction may rotate about the centre of rotation. According to various embodiments, in an area of the second sliding surface, a portion of the first lever may have a different shape in the various embodiments including, circular, oval, a convex section broken by a concave section etc, as long as the second sliding surface is convex, at least at the abutment point. Accordingly, in the above mentioned area of the second sliding surface, in some embodiments, there may be two or more separate second sliding surfaces on the actuation part, one at a time being in abutment with the first sliding surface as the dispensing stroke progresses. According to some embodiments, the centre of rotation may move as the abutment point moves along the sliding surfaces.

According to embodiments, the first sliding surface may be substantially flat. Alternatively, the first sliding surface may be concave or convex.

According to embodiments, the point of action of the transfer force on the actuation part may coincide with the centre of rotation of the transfer force.

According to embodiments, a link part may convey the transfer force from the user lever to the actuation part. In this manner, the transfer force may be transferred via the link part to the user lever.

According to embodiments, the link part may be pivotably attached to the actuation part and arranged to pivot about the centre of rotation. The point of action thus, may be at the centre of rotation. In this manner, the transfer force from user lever may be transferred to the actuation part via the link part to the centre of rotation.

According to embodiments, the link part may be pivotably attached to the user lever.

According to embodiments, the dispensing mechanism may be adapted for actuating an outlet mechanism including a hollow flexible dispensing portion. The dispensing mechanism may include a fixed dolly adapted to abut against the hollow flexible dispensing portion. The contact surface of the actuation part may be adapted to abut against the flexible dispensing portion such that the hollow flexible dispensing portion may be able to be arranged between the contact surface and the dolly. In this manner, liquid may be dispensed from the flexible dispensing portion as the actuation part is moved in a direction towards the dolly by the transfer force.

According to embodiments, the dispensing mechanism may be adapted for actuating an outlet mechanism including a pump mechanism including a fixed pump part and a movable pump part arranged in slidable relation to the fixed pump part. The contact surface of the actuation part may be adapted to abut against the movable pump part for actuating the movable pump part when the actuation part is subjected to a dispensing stroke. In this manner, liquid may be dispensed from the pump mechanism as the actuation part is moved in a direction towards the movable pump part by the transfer force.

According to embodiments, the actuation part may be arranged to pivot about a second pivot axis.

According to embodiments, the first and second pivot axes may be substantially parallel to each other, and a first plane may extend through the first and second pivot axes. In a non-actuated position of the dispensing mechanism, the user operated portion of the user lever may be arranged on a first side of the first plane. The user force and the transfer force may be applied from the first side of the first plane at least at a beginning of a dispensing stroke of the actuation part.

According to embodiments, the centre of rotation may remain on the first side of the first plane over the entire dispensing stroke.

According to embodiments, the contact surface of the actuation part may be arranged closer to a second end of the actuation part than the second pivot axis is. The first pivot axis may be arranged at a first end of the user lever, and the user operated portion may be arranged at a second end of the user lever.

According to embodiments, the actuation part may be arranged to slide along a guide path during the dispensing stroke. In this manner, the actuation part may be directed in a controlled way towards the outlet mechanism as the actuation part is subjected to the transfer force.

It is further desired to provide a dispenser with a dispensing mechanism which will allow a user to easily dispense a liquid from an outlet mechanism of a liquid container or an outlet mechanism of the dispenser.

According to a further aspect, a dispenser for a liquid includes a dispensing mechanism according to any of the aspects and embodiments discussed above.

According to embodiments, the dispenser may be adapted for wall-mounting.

According to embodiments, the dispenser may include a seat for receiving a disposable liquid container.

According to embodiments, the dispenser may include a liquid container adapted to be refilled with a liquid. Alternatively, the liquid container may be disposable.

According to embodiments, the dispenser may include an outlet mechanism including a hollow flexible dispensing portion. According to these embodiments, the liquid container may be connected to the hollow flexible portion. The liquid container may be disposable or refillable.

According to embodiments, a disposable liquid container may include the hollow flexible portion.

According to embodiments, the dispensing mechanism may be arranged at a lower end of the dispenser.

Further features of, and advantages with, the present invention will become apparent when studying the appended claims and the following detailed description. Those skilled in the art will realize that different features of the present invention may be combined to create embodiments other than those described in the following, without departing from the scope of the present invention, as defined by the appended claims.

BRIEF DESCRIPTION OF THE DRAWINGS

The various aspects of embodiments of the invention, including particular features and advantages, will be readily understood from the following detailed description and the accompanying drawings, in which.

DETAILED DESCRIPTION

The present invention will now be described more fully with reference to the accompanying drawings, in which example embodiments are shown. However, this invention should not be construed as limited to the embodiments set forth herein. Disclosed features of example embodiments may be combined as readily understood by one of ordinary skill in the art to which this invention belongs. Like numbers refer to like elements throughout.

Well-known functions or constructions will not necessarily be described in detail for brevity and/or clarity.

Figure 1:
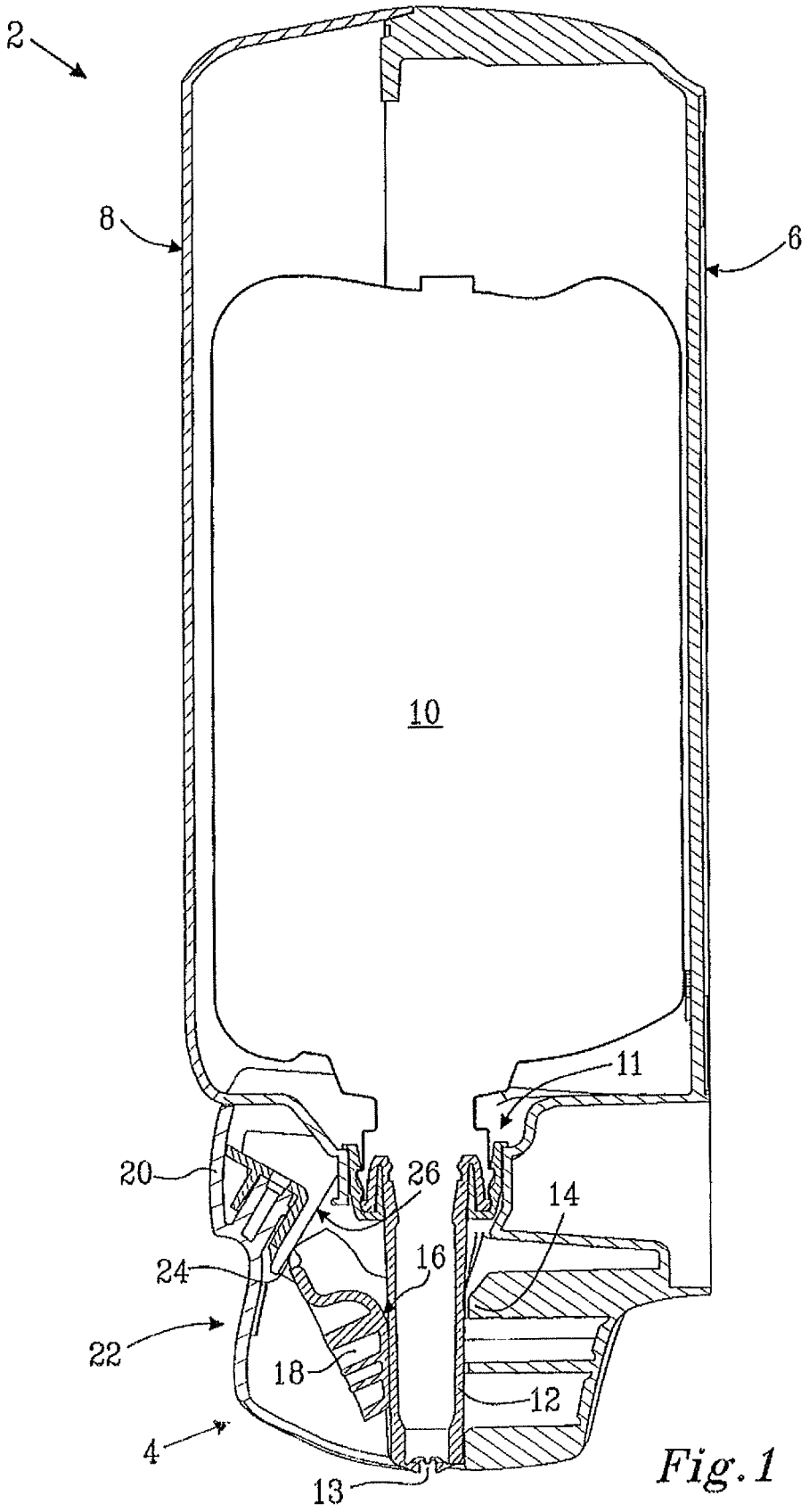
FIG. 1 illustrates a cross section through a dispenser for liquid according to example embodiments.

FIG. 1 illustrates a cross section through a dispenser 2 for liquid according to example embodiments. The dispenser 2 includes a dispensing mechanism 4. The dispenser 2 includes a wall mountable portion 6 and a lid 8. Inside the dispenser 2 a liquid container 10 for a liquid such as liquid soap is arranged. There is provided a seat 11 for the container 10 in the dispenser. The lid 8 may be opened in order to replace or refill the liquid container 10. Accordingly, the container 10 may either be disposable or refillable. An outlet mechanism comprising a hollow flexible dispensing portion 12 is arranged at a lower end of the dispenser 2 and is arranged in liquid communication with an inside of the liquid container 10. The flexible portion 12 is provided with an opening 13 and may form part of the dispenser 2 itself or of the liquid container 10.

The dispensing mechanism 4 includes a user lever 20 arranged to pivot about a first pivot axis. The user lever 20 includes a user operated portion 22. The user operated portion 22 is typically arranged at one end of the user lever 20 and may be as simple as a surface for a user to press against.

The flexible portion 12 is arranged between a fixed dolly 14 and a contact surface 16 of a movable actuation part 18 of the dispensing mechanism 4. The actuation part 18 includes a lever. The actuation part 18 is arranged to pivot about a second pivot axis. The user lever 20 includes a first sliding surface 26. The actuation part 18 includes a second sliding surface 24, which is convex. The first and second sliding surfaces 26, 24 bear in sliding abutment against each other at an abutment point. Accordingly, when the user lever 20 is pivoted towards the actuation part 18, the actuation part 18 is pivoted in a direction towards the dolly 14 and the flexible portion 12 is squeezed between the contact surface 16 and the dolly 14. A valve may be arranged in the flexible portion 12 close to the opening 13 to prevent liquid from dripping out of the liquid container 10 when the flexible portion 12 is not squeezed. Similarly, a valve may be arranged between the flexible portion 12 and the liquid container 10 in order to prevent liquid from being pressed back into the container 10 when the flexible portion 12 is being squeezed. Such valves are known in the art.

Figure 2A:
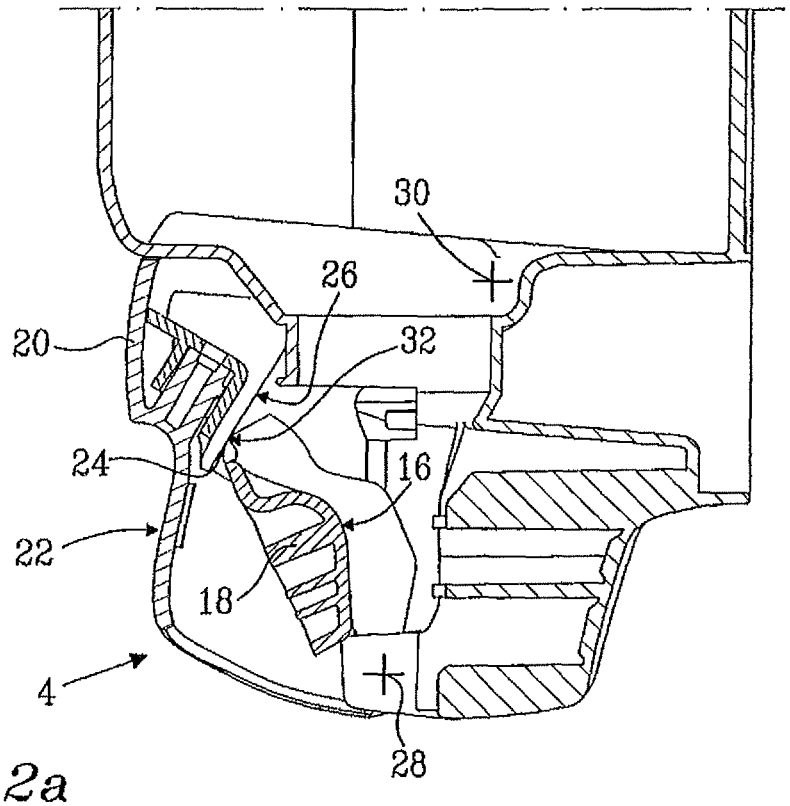
FIGS. 2*a* and 2*b* illustrate a dispensing mechanism according to example embodiments.
Figure 2B:
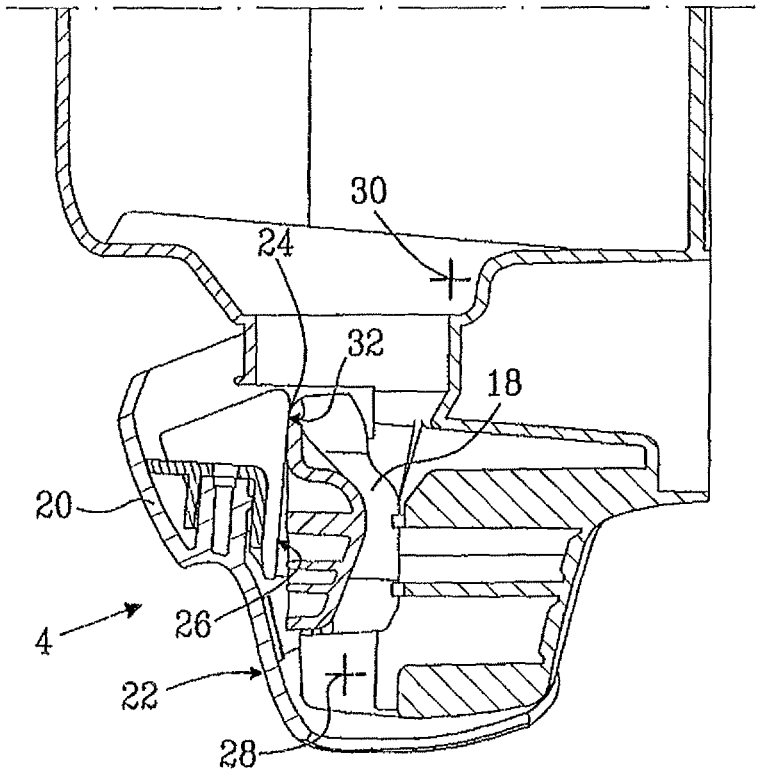

FIGS. 2*a* and 2*b* illustrate a dispensing mechanism 4 according to example embodiments. FIG. 2*a* illustrates the dispensing mechanism 4 in a non-actuated position and FIG. 2*b* illustrates the dispensing mechanism 4 in a substantially fully actuated position. An outlet mechanism including a hollow flexible dispensing portion of a dispenser associated with the dispensing mechanism 4 has been omitted in FIGS. 2*a* and 2*b* for clarity reasons.

A user lever 20 pivots about a first pivot axis 30. The user lever 20 is adapted to be operated by a user in order to dispense a liquid from the dispenser associated with the dispensing mechanism 4. The user lever 20 is provided with a user operated portion 22 for this purpose. An actuation part 18 pivots about a second pivot axis 28. The actuation part 18 includes a contact surface 16 adapted to abut against the non-shown hollow flexible dispensing portion.

The user lever 20 includes a first sliding surface 26, which is substantially flat. The actuation part 18 includes a second sliding surface 24, which is convex. The first and second sliding surfaces 26, 24 bear in sliding abutment against each other at an abutment point 32. The actuation part 18 performs a dispensing stroke as a user presses against the user operated portion 22 of the user lever 20, starting from a non-actuated position of the dispensing mechanism 4 (FIG. 2*a*) and ending at a fully actuated position (FIG. 2*b*). Accordingly, the abutment point 32 travels along the first and second sliding surfaces 26, 24 as the dispensing stroke progresses when a user force is applied to the user operated portion 22. The user force translates into a transfer force applied from the user lever 20 to the actuation part 18 at the abutment point 32, which constitutes a point of action for the transfer force on actuation part 18.

The second pivot axis 28 is arranged at a first end of the actuation part 18. The second sliding surface 24 and the contact surface 16 are arranged closer to a second end of the actuation part 18 than to the second pivot axis 28. The first pivot axis 30 is arranged at a first end of the user lever 20. The first sliding surface 26 and the user operated portion 22 are arranged closer to a second end of the user lever 20 than the first pivot axis 30 is, i.e. seen in a direction from the first end of the user lever 20, the first pivot axis 30, the first sliding surface 26, and the user operated portion 22 are arranged in that order.

As will be explained below, a constant force applied to the user operated portion 22 will lead to an increasing force being applied to the non-shown hollow flexible dispensing portion by the actuation part 18 as the dispensing stroke progresses.

Figure 3:
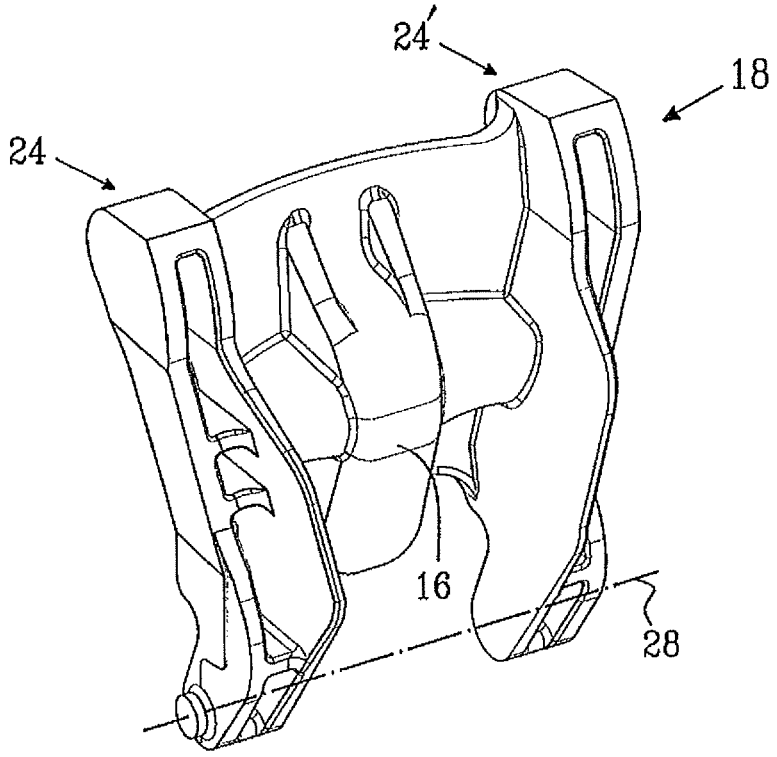
FIG. 3 illustrates a first lever of a dispensing mechanism according to example embodiments.

FIG. 3 illustrates an actuation part 18 including a lever of a dispensing mechanism according to example embodiments. The actuation part 18 is adapted to pivot about a second pivot axis 28. The actuation part 18 includes two second sliding surfaces 24, 24' arranged side by side and in parallel with each other. The second sliding surfaces 24, 24' are adapted to abut against one or two first sliding surfaces of a user lever. A contact surface 16 adapted to abut against an outlet mechanism including a hollow flexible dispensing portion of a dispenser is arranged between the two second sliding surfaces 24, 24'. The contact surface 16 may be convex.

Figure 4:
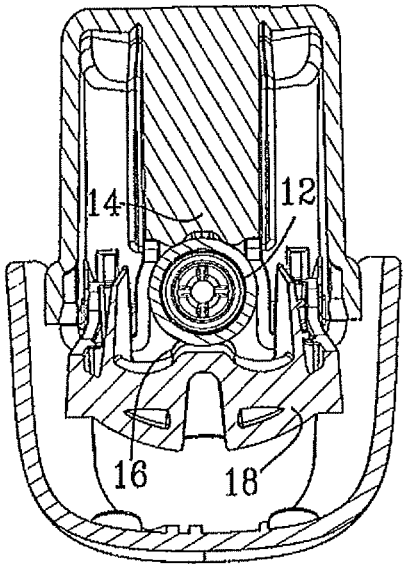
FIG. 4 illustrates a cross section through a dispensing mechanism according to example embodiments.

FIG. 4 illustrates a cross section through a dispensing mechanism 4 according to example embodiments. A hollow flexible dispensing portion 12 is arranged between a contact surface 16 of an actuation part 18 and a dolly 14. The dolly 14 abuts against the flexible portion 12 only over less than half of a circumference of the flexible portion 12. In this manner, the flexible portion 12 may be more easily pressed together than if a larger part of the dolly 14 abuts against the flexible portion 12.

Figure 5:
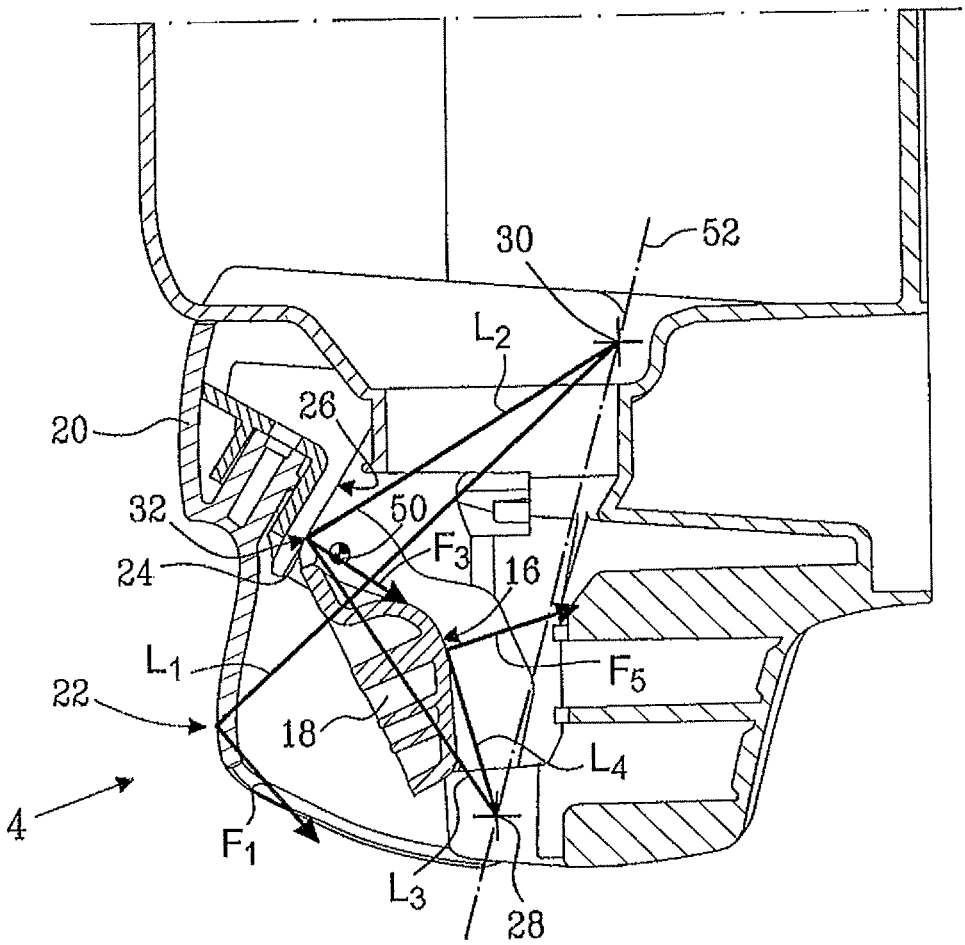
FIGS. 5-11 illustrate dispensing mechanisms according to example embodiments.

FIG. 5 illustrates a dispensing mechanism 4 according to example embodiments. Again, an actuation part 18 pivots about a second pivot axis 28. The actuation part 18 includes a contact surface 16 adapted to abut against an outlet mechanism comprising a non-shown hollow flexible dispensing portion. A user lever 20 pivots about a first pivot axis 30. The user lever 20 is adapted to be operated by a user in order to dispense a liquid from a dispenser associated with the dispensing mechanism 4. The user lever 20 is provided with a user operated portion 22 for this purpose. The actuation part 18 includes a second sliding surface 24, which is convex and has a radius with a centre point. The radius of the convex second sliding surface 24 may be seen as a transfer force direction, along which a transfer force F3 is directed during a dispensing stroke. The centre point may be seen as centre of rotation 50 associated with the actuation part 18, about which centre of rotation 50 the transfer force F3 rotates as the dispensing stroke progresses. The radius may for instance be 2-30 mm. The user lever 20 includes a first sliding surface 26, which is substantially flat. The first and second sliding surfaces 26, 24 bear in sliding abutment against each other at an abutment point 32. As a user presses against the user operated portion 22 of the user lever 20, the actuation part 18 performs a dispensing stroke. The abutment point 32 passes along the first and second sliding surfaces 26, 24 as the dispensing stroke progresses.

The first and second pivot axes 30, 28 are substantially parallel to each other, and a first plane 52 extends through the first and second pivot axes 30, 28. The second pivot axis 28, the first pivot axis 30, and the abutment point 32 form corners of a triangle in a second plane substantially perpendicular to the first and second pivot axes 30, 28. In the illustrated non-actuated position of the dispensing mechanism 4, the user operated portion 22 of the user lever 20, the centre of rotation 50, and the abutment point 32 are arranged on a first side of the first plane 52.

In FIG. 5 a first length L1 and a second length L2 are indicated. The first length L1 extends between the first pivot axis 30 and the user operated portion 22 where a user may apply a user force F1. The second length L2 extends from the first pivot axis 30 to the abutment point 32 forming a point of action of the transfer force F3 applied from the user lever 20 to the actuation part 18. The transfer force F3 rotates about the centre of rotation 50 as the dispensing stroke progresses. A leverage ratio is formed between the first length L1 and the second length L2. The first length L1 is constant over an entire dispensing stroke. The second length L2 however, decreases as the dispensing stroke progresses, because the abutment point 32 moves closer to the first pivot axis 30 as the dispensing stroke progresses. Accordingly, the leverage ratio will increase over a dispensing stroke. A constant user force F1 applied to the user operated portion 22 entails that an applied force F5 onto the non-shown hollow flexible dispensing portion increases over the dispensing stroke.

Seen from a mechanics perspective, the leverage ratio will increase during a dispensing stroke as long as the centre of rotation 50 remains on the first side of the first plane 52. If the dispensing stroke reaches an end with the centre of rotation 50 remaining on the first side of the first plane 52 (compare FIG. 2*b*), this means that the leverage ratio will increase over the entire dispensing stroke.

Purely provided as an example, the embodiments illustrated in FIG. 5 may have a distance between the first and second pivot axes 30, 28 of about 63 mm, and a first length L1 of about 73 mm. The second length L2 decreases over the dispensing stroke from an initial length of about 48 mm to a length of about 32 mm at the end of the dispensing stroke. The actuation part 18 is associated with a third length L3 extending between the second pivot axis 28 and the abutment point 32 and a fourth length L4 extending between the second pivot axis 28 and the contact surface 16. The third length L3 decreases over the dispensing stroke from an initial length of about 44 mm to a length of about 41 mm at the end of the dispensing stroke. The fourth length L4 is 23 mm. Such an arrangement results in a user force F1 of 20 Newton being applied to the user portion 22 over the entire dispensing stroke for the applied force F5 to increase from 22 Newton at the beginning of the dispensing stroke to 50 Newton at the end of the dispensing stroke. For a full dispensing stroke of the actuation part 18, the user lever 20 travels about 34 mm at the user operated portion 22. It may be noted that the decrease of the third length L3 over the dispensing stroke results in a decreasing leverage ratio between the third and fourth lengths L3, L4 over the dispensing stroke. However, this decrease is minor in comparison with the leverage ratio increase of the first and second lengths L1, L2.

Any dispensing mechanism should, from a practical perspective, be designed to operate with a user force of a level that a user in practice may apply to a user portion 22 of the user lever 20. Due to the increasing leverage ratio in dispensing mechanisms according to embodiments, the user force required for pressing the user lever 20 may remain within practicable user force levers, also when the non-shown hollow flexible dispensing portion affects the user force. The leverage ratio may not be required to increase over the entire dispensing stroke. After for instance about half a dispensing stroke, the leverage ratio may be allowed to decrease again and, accordingly, the dispensing mechanisms may alternatively be designed such that the centre of rotation 50 passes from the first side of the first plane 52 to a second side of the first plane 52 after about half a dispensing stroke. In such a case the dispensing mechanism may suitably be designed such that a required user force at an end of a dispensing stroke is not substantially above a level at a beginning of the dispensing stroke.

According to example embodiments, in an area of the second sliding surface 24, a portion of the actuation part 18 may have many different shapes including, partially circular, partially oval, a convex section broken by a concave section etc.—as long as the second sliding surface 24 is convex, at least at the abutment point 32, and bearing in mind that the abutment point 32 passes along the second sliding surface 24 as a dispensing stroke progresses. Accordingly, in the above mentioned area of the second sliding surface 24 there may be two or more sliding surfaces on the actuation part 18, one at a time being in abutment with a first sliding surface 26 as the dispensing stroke progresses. For some shapes of the convex second sliding surface 24, the centre of rotation 50 may shift as the dispensing stroke progresses. Still, the leverage ratio will increase as long as a present centre of rotation 50 remains on the first side of the first plane 52. Also, the first sliding surface 26 may have a different shape than substantially flat; it may for instance be convex or concave.

Figure 6A:
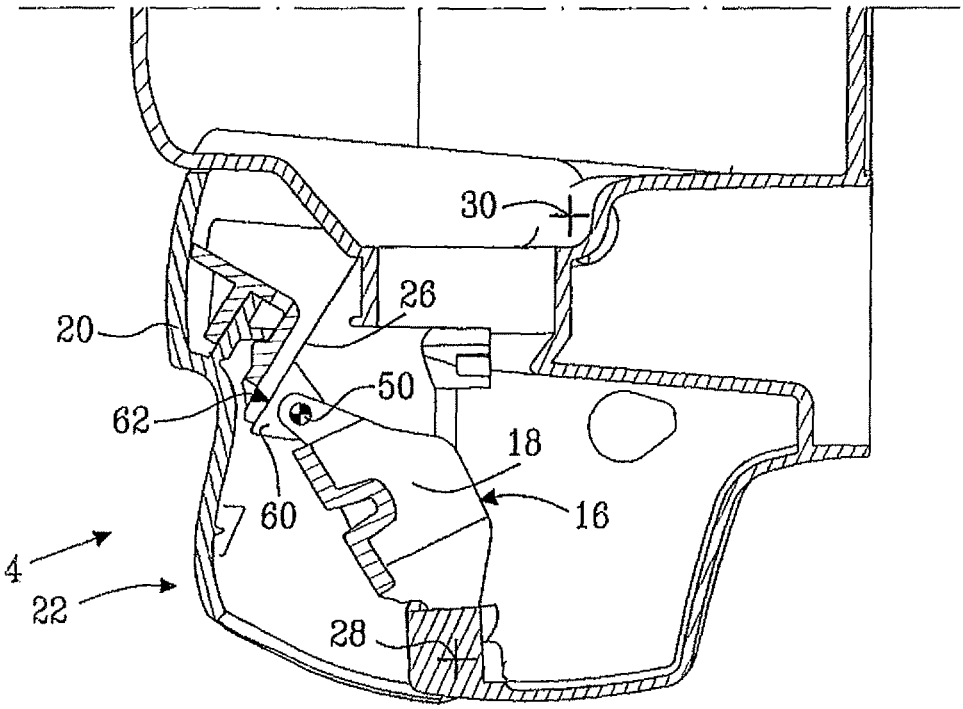
Figure 6B:
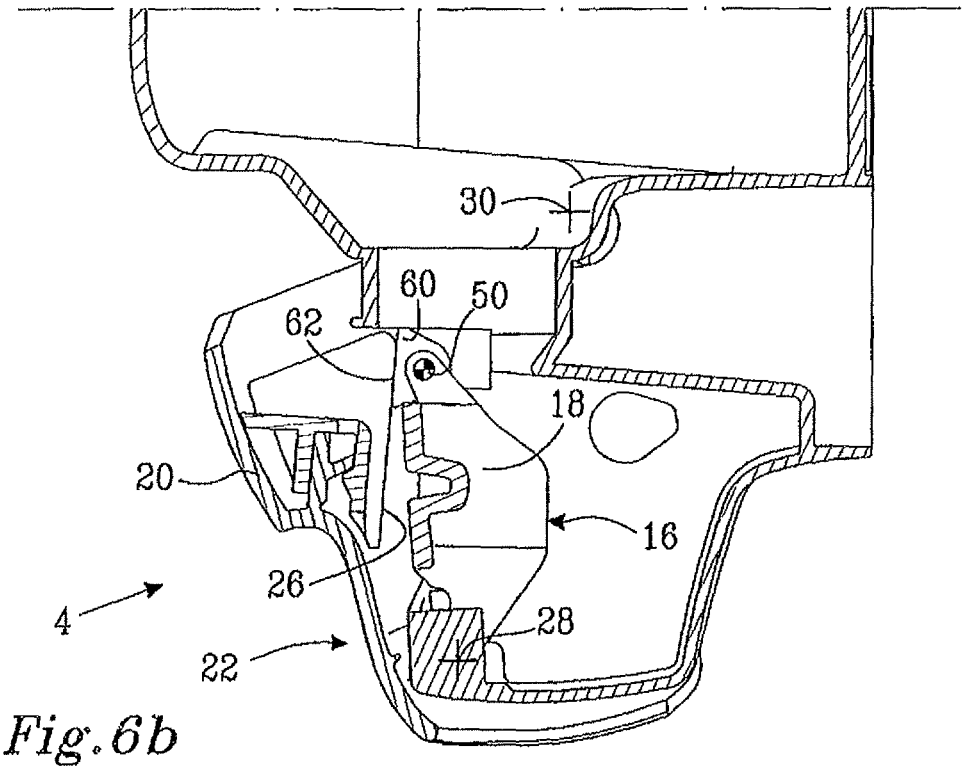

FIGS. 6*a* and 6*b* illustrate a dispensing mechanism 4 according to example embodiments. FIG. 6*a* illustrates the dispensing mechanism 4 in a non-actuated position and FIG. 6*b* illustrates the dispensing mechanism 4 in a substantially fully actuated position. An outlet mechanism including a hollow flexible dispensing portion of a dispenser associated with the dispensing mechanism 4 has been omitted in FIGS. 6*a* and 6*b* for clarity reasons.

A user lever 20 pivots about a first pivot axis 30. The user lever 20 is adapted to be operated by a user in order to dispense a liquid from the dispenser associated with the dispensing mechanism 4. The user lever 20 is provided with a user operated portion 22 for this purpose. An actuation part 18 pivots about a second pivot axis 28. The actuation part 18 includes a contact surface 16 adapted to abut against the non-shown hollow flexible dispensing portion.

A link part 60 is connected to the actuation part 18. The link part 60 is pivotably attached to the actuation part 18 and includes a third sliding surface 62. The link part 60 pivots about a centre of rotation 50 associated with the actuation part 18. The user lever 20 includes a first sliding surface 26. The first and third sliding surfaces 26, 62 bear in sliding abutment against each other. The actuation part 18 performs a dispensing stroke as a user presses with a user force against the user operated portion 22 of the user lever 20, starting from a non-actuated position of the dispensing mechanism 4 (FIG. 6*a*) and ending at a fully actuated position (FIG. 6*b*). Accordingly, the third sliding surface 62 slides along the first sliding surface 26 as the dispensing stroke progresses. The user force translates into a transfer force applied from the first surface 26 of the user lever 20 to the centre of rotation 50 associated with the actuation part 18. The transfer force rotates about the centre of rotation 50 as the dispensing stroke continues. The centre of rotation 50 constitutes a point of action for the transfer force on actuation part 18.

Similarly, as explained above in connection with FIG. 5, a leverage ratio between a first length and a second length will increase over the dispensing stroke. The first length extends between the first pivot axis 30 and the user operated portion 22. The second length extends in this case from the first pivot axis 30 to the centre of rotation 50 forming a point of action of the transfer force applied from the user lever 20 to the actuation part 18. The first length is constant over an entire dispensing stroke. Again however, the second length decreases as the dispensing stroke progresses because the centre of rotation 50 moves closer to the first pivot axis 30 as the dispensing stroke progresses. Accordingly, the leverage ratio will increase over at least part of a dispensing stroke. A constant user force applied to the user operated portion 22 entails that an applied force onto the non-shown hollow flexible dispensing portion increases over at least part of the dispensing stroke.

The leverage ratio will increases during a dispensing stroke as long as the centre of rotation 50 remains on the first side of a first plane extending through the parallel first and second pivot axes 30, 28, see also FIG. 5.

According to alternative embodiments, the first sliding surface 26 may be convex and the third sliding surface 62 may be concave, the first and third sliding surfaces 26, 62 having the same curvature such that they may abut against each other.

Figure 7A:
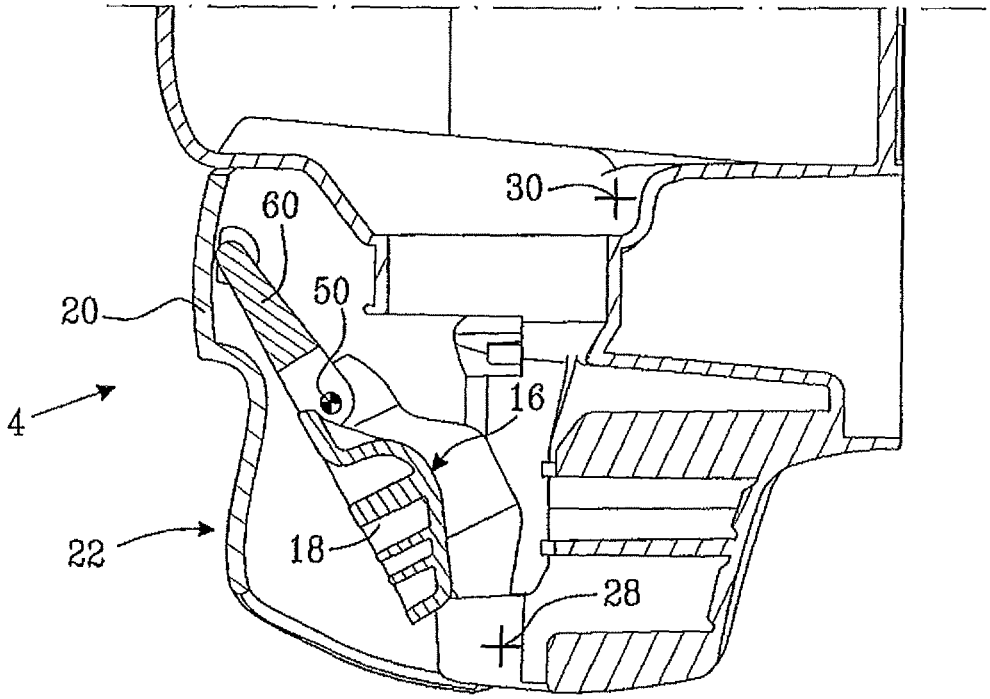
Figure 7B:
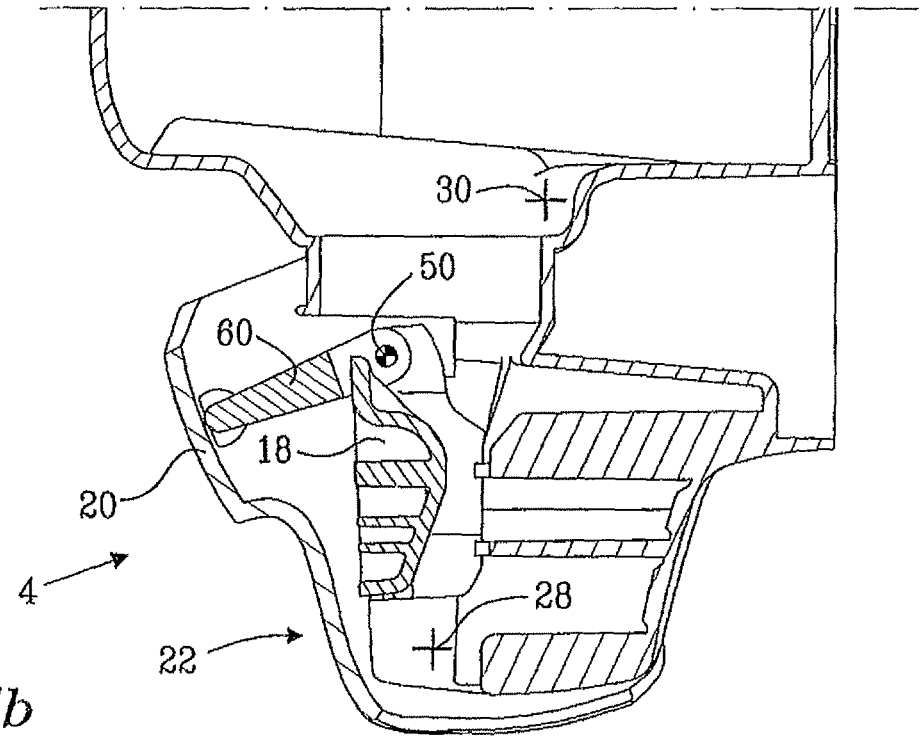

FIGS. 7*a* and 7*b* illustrate a dispensing mechanism 4 according to example embodiments. FIG. 7*a* illustrates the dispensing mechanism 4 in a non-actuated position and FIG. 7*b* illustrates the dispensing mechanism 4 in a substantially fully actuated position. An outlet mechanism including a hollow flexible dispensing portion of a dispenser associated with the dispensing mechanism 4 has been omitted in FIGS. 7*a* and 7*b* for clarity reasons.

A user lever 20 pivots about a first pivot axis 30. The user lever 20 is adapted to be operated by a user in order to dispense a liquid from the dispenser associated with the dispensing mechanism 4. The user lever 20 is provided with a user operated portion 22 for this purpose. An actuation part 18 pivots about a second pivot axis 28. The actuation part 18 includes a contact surface 16 adapted to abut against the non-shown hollow flexible dispensing portion.

A link part 60 is connected to the actuation part 18. The link part 60 is pivotably attached to the actuation part 18 and pivotably attached to the user lever 20. The link part 60 pivots about a centre of rotation 50 associated with the actuation part 18. The actuation part 18 performs a dispensing stroke as a user presses with a user force against the user operated portion 22 of the user lever 20, starting from a non-actuated position of the dispensing mechanism 4 (FIG. 7*a*) and ending at a fully actuated position (FIG. 7*b*). Accordingly, the link part 60 pivots at both its ends as the dispensing stroke progresses. The user force translates into a transfer force applied via the link part 60 to the centre of rotation 50 associated with the actuation part 18. The transfer force rotates about the centre of rotation 50 as the dispensing stroke continues. The centre of rotation 50 constitutes a point of action for the transfer force on actuation part 18.

Similarly, as explained above in connection with FIG. 5, a leverage ratio between a first length and a second length will increase over the dispensing stroke. The first length extends between the first pivot axis 30 and the user operated portion 22. The second length extends in this case from the first pivot axis 30 to the centre of rotation 50 forming a point of action of a transfer force applied from the user lever 20 to the actuation part 18. The first length is constant over an entire dispensing stroke. Again however, the second length decreases as the dispensing stroke progresses, because the centre of rotation 50 moves closer to the first pivot axis 30 as the dispensing stroke progresses. Accordingly, the leverage ratio will increase over at least part of a dispensing stroke. A constant user force applied to the user operated portion 22 entails that an applied force onto the non-shown hollow flexible dispensing portion increases over at least part of the dispensing stroke.

The leverage ratio will increase during a dispensing stroke as long as the centre of rotation 50 remains on the first side of a first plane extending through the parallel first and second pivot axes 30, 28, see also FIG. 5.

Figure 8A:
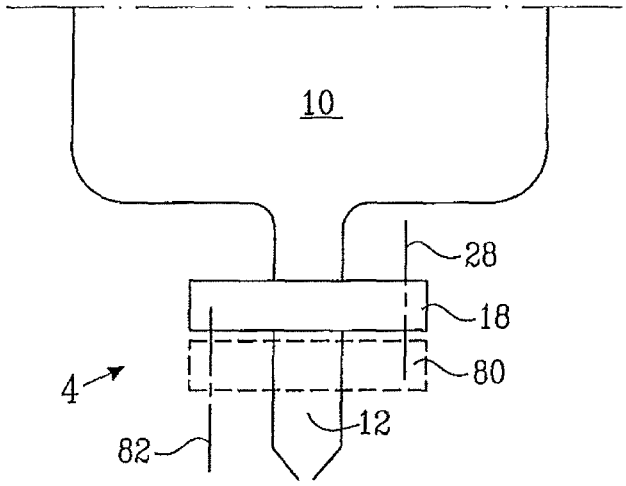
Figure 8B:
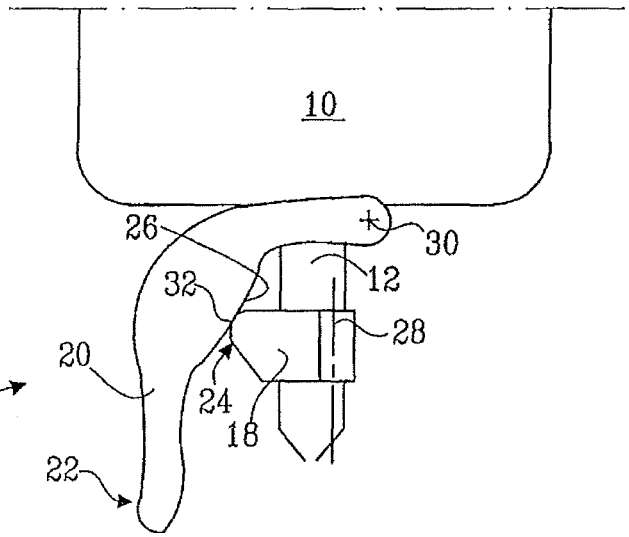

FIGS. 8*a* and 8*b* illustrate schematically part of a dispensing mechanism 4 according to example embodiments. FIG. 8*a* illustrates a frontal view of an actuation part 18 of the dispensing mechanism 4. FIG. 8*b* illustrates a side view of the actuation part 18 and a user lever 20.

The dispensing mechanism 4 is arranged to abut against an outlet mechanism including a hollow flexible dispensing portion 12 arranged in fluid communication with a liquid container 10. The user lever 20 is arranged to pivot about a first pivot axis 30 to pivot towards a non-shown dolly when a user applies a user force to a user operated portion 22 of the user lever 20. The actuation part 18 is arranged to pivot about a second pivot axis 28. The first and second pivot axes 30, 28 are arranged at an angle to each other and in different planes. The user lever 20 includes a first sliding surface 26 and the actuation part 18 includes a second sliding surface 24. The second sliding surface 24 is convex. The first and second, sliding surfaces 26, 24 bear in sliding abutment against each other at an abutment point 32. The user force applied to the user operated portion 22 of the user lever 20 is translated into a transfer force applied from the first sliding surface 26 to the second sliding surface 24 at the abutment point 32. As a user presses against the user operated portion 22 of the user lever 20, the actuation part 18 performs a dispensing stroke. The abutment point 32 passes along the first and second sliding surfaces 26, 24 as the dispensing stroke progresses.

A first length extends between the first pivot axis 30 and the user operated portion 22 and a second length extends from the first pivot axis 30 to the abutment point 32 forming a point of action of the transfer force. A leverage ratio is formed between the first length and the second length. The first length is constant over an entire dispensing stroke. The second length however, decreases as the dispensing stroke progresses because the abutment point 32 moves closer to the first pivot axis 30 as the dispensing stroke progresses. Accordingly, the leverage ratio will increase over at least part of a dispensing stroke. A constant user force applied to the user operated portion 22 entails that an applied force onto the hollow flexible dispensing portion 12 increases over at least part of the dispensing stroke.

In FIG. 8*a* an optional second actuation part 80 is indicated with broken lines. The second actuation part 80 is arranged to pivot about a third pivot axis 82. The second actuation part 80 may be arranged to bear in sliding abutment against the user lever 20. In an arrangement with the first and second pivot axes 30, 28 arranged at an angle to each other, the use of two actuation parts 18, 82 may be advantageous. Since the two actuation parts 18, 80 abut symmetrically on both sides of the flexible dispensing portion 12 against the user lever 20, the user lever 20 may be subjected to symmetrical forces when a user presses against the user operated portion 22.

Figure 9:
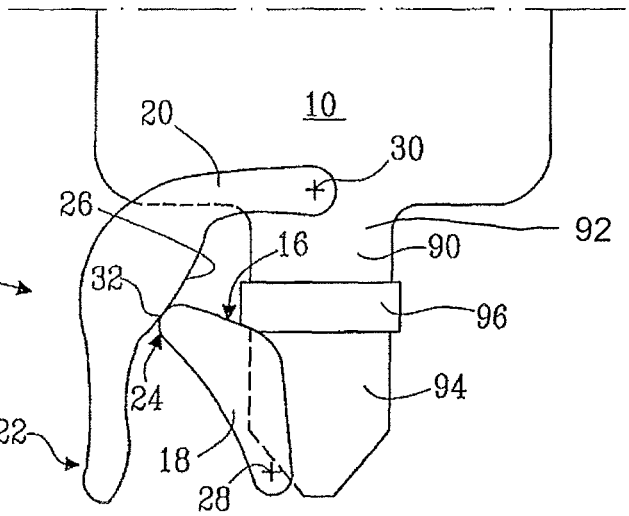

FIG. 9 illustrates a dispensing mechanism 4 according to example embodiments. The dispensing mechanism 4 is adapted to actuate an outlet mechanism of a container 10, the outlet mechanism including a pump mechanism 90 including a fixed pump part 92 and a movable pump part 94. The pump mechanism 90 is in liquid communication with the container 10. The movable pump part 94 is arranged in slidable relation to the fixed pump part 92 such that one pump stroke of the movable pump part 94 dispenses a metered amount of liquid through an opening in the movable pump part 94. During the pump stroke, air may be mixed into the liquid to dispense a foamed liquid.

A user lever 20 is arranged to pivot about a first pivot axis 30 when a user applies a user force to a user operated portion 22 of the user lever 20. An actuation part 18 is arranged to pivot about a second pivot axis 28. The user lever 20 includes a first sliding surface 26 and the actuation part 18 includes a second sliding surface 24. The second sliding surface 24 is convex. The first and second sliding surfaces 26, 24 bear in sliding abutment against each other at an abutment point 32. The user force applied to the user operated portion 22 of the user lever 20 is translated into a transfer force applied from the first sliding surface 26 to the second sliding surface 24 at the abutment point 32. The actuation part 18 includes a contact surface 16. The contact surface 16 is adapted to abut against a flange 96 of the movable pump part 94.

When a user presses against the user operated portion 22 of the user lever 20, the actuation part 18 performs a dispensing stroke. The abutment point 32 passes along the first and second sliding surfaces 26, 24 as the dispensing stroke progresses. During the dispensing stroke the contact surface 16 presses against the flange 96 to cause the movable pump part 94 perform a pump stroke.

A first length extends between the first pivot axis 30 and the user operated portion 22 and a second length extends from the first pivot axis 30 to the abutment point 32 forming a point of action of the transfer force. A leverage ratio is formed between the first length and the second length. The first length is constant over an entire dispensing stroke. The second length however, decreases as the dispensing stroke progresses, because the abutment point 32 moves closer to the first pivot axis 30 as the dispensing stroke progresses. Accordingly, the leverage ratio will increase over at least part of a dispensing stroke. A constant user force applied to the user operated portion 22 entails that an applied force onto the hollow flexible dispensing portion 12 increases over at least part of the dispensing stroke.

Figure 10:
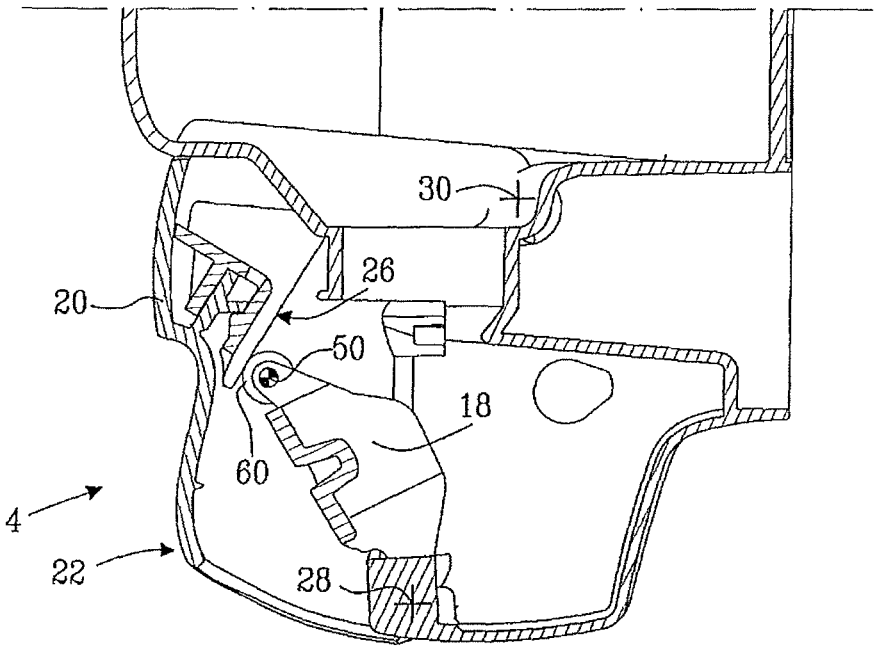

FIG. 10 illustrates a dispensing mechanism 4 according to example embodiments. The dispensing mechanism 4 bears similarities with the embodiments illustrated in FIGS. 6*a* and 6*b*. The main difference lies in that a link part 60 includes a wheel and thus, is adapted to roll along a first sliding surface 26 of a user lever 20. The link part 60 rotates about a centre of rotation 50. When a user presses against a user operated portion 22 of the user lever 20, a transfer force from the user lever 20 is applied to the actuation part 18 via the centre of rotation 50 and the actuation part performs a dispensing stroke.

A leverage ratio between a first length and a second length will increase over the dispensing stroke. The first length extends between a first pivot axis 30 and the user operated portion 22. The second length extends from the first pivot axis 30 to the centre of rotation 50 forming a point of action of the transfer force. The first length is constant over an entire dispensing stroke. The second length decreases as the dispensing stroke progresses, because the centre of rotation 50 moves closer to the first pivot axis 30 as the dispensing stroke progresses. Accordingly, the leverage ratio will increase over at least part of a dispensing stroke. A constant user force applied to the user operated portion 22 entails that an applied force onto the non-shown outlet mechanism increases over at least part of the dispensing stroke.

The leverage ratio will increase during a dispensing stroke as long as the centre of rotation 50 remains on the first side of a first plane extending through the parallel first and second pivot axes 30, 28, see also FIG. 5.

Figure 11:
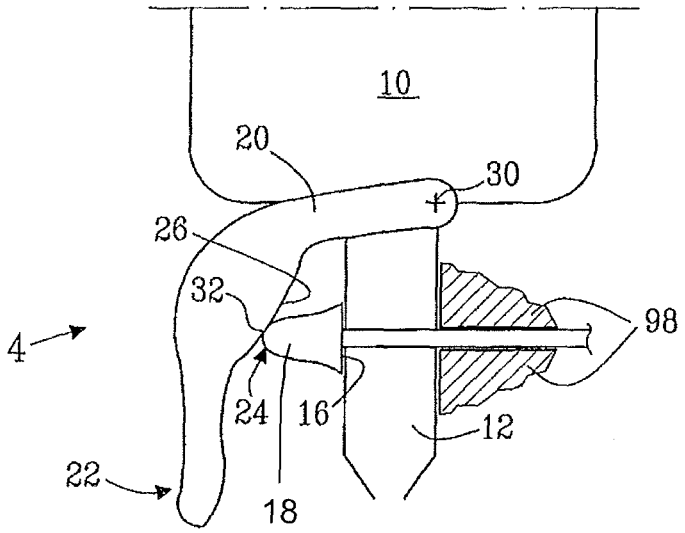

FIG. 11 illustrates illustrate a dispensing mechanism 4 according to example embodiments. The dispensing mechanism 4 includes a user lever 20 arranged to pivot about a first pivot axis 30 and a slidable actuation part 18. An outlet mechanism including a hollow flexible dispensing portion 12 of a dispenser is arranged in fluid communication with a liquid container 10.

The actuation part 18 is supported by guide means 98 forming a guide path. The actuation part 18 may thus perform a sliding movement in two directions along the guide path. The movement of the actuation part 18 is thus, guided only by the guide path. The actuation part 18 includes a contact surface 16 adapted to abut against the hollow flexible dispensing portion 12. The user lever 20 is adapted to be operated by a user in order to dispense a liquid from the dispenser. The user lever 20 is provided with a user operated portion 22 for this purpose.

The user lever 20 includes a first sliding surface 26. The actuation part 18 includes a second sliding surface 24. The first and second sliding surfaces 26, 24 bear in sliding abutment against each other at an abutment point 32. The actuation part 18 performs a dispensing stroke as a user presses against the user operated portion 22 of the user lever 20, starting from a non-actuated position of the dispensing mechanism 4. Accordingly, the abutment point 32 travels along the first and second sliding surfaces 26, 24 as the dispensing stroke progresses when a user force is applied to the user operated portion 22. The user force translates into a transfer force applied from the user lever 20 to the actuation part 18 at the abutment point 32.

A leverage ratio between a first length and a second length will increase over the dispensing stroke. The first length extends between the first pivot axis 30 and the user operated portion 22. The second length extends from the first pivot axis 30 to the abutment point 32 forming a point of action of a transfer force applied from the user lever 20 to the actuation part 18. The first length is constant over an entire dispensing stroke. Again however, the second length decreases as the dispensing stroke progresses, because the abutment point moves closer to the first pivot axis 30 as the dispensing stroke progresses. Accordingly, the leverage ratio will increase over at least part of a dispensing stroke. A constant user force applied to the user operated portion 22 entails that an applied force onto the hollow flexible dispensing portion 12 increases over at least part of the dispensing stroke.

Although the invention has been described with reference to example embodiments, many different alterations, modifications and the like will become apparent for those skilled in the art. Example embodiments described above may be combined as understood by a person skilled in the art. For instance may an actuation part be arranged to pivot about a pivot axis as well as being guide along a guide path.

Therefore, it is to be understood that the foregoing is illustrative of various example embodiments and the invention is not to be limited to the specific embodiments disclosed and that modifications to the disclosed embodiments, combinations of features of disclosed embodiments as well as other embodiments are intended to be included within the scope of the appended claims.

As used herein, the term "comprising" or "comprises" is open-ended, and includes one or more stated features, elements, steps, components or functions but does not preclude the presence or addition of one or more other features, elements, steps, components, functions or groups thereof.

As used herein, the term "and/or" includes any and all combinations of one or more of the associated listed items.

As used herein, the common abbreviation "e.g.", which derives from the Latin phrase "exempli gratia," may be used to introduce or specify a general example or examples of a previously mentioned item, and is not intended to be limiting of such item. If used herein, the common abbreviation "i.e.", which derives from the Latin phrase "id est," may be used to specify a particular item from a more general recitation.

The terminology used herein is for the purpose of describing particular embodiments only and is not intended to be limiting. As used herein, the singular forms "a", "an" and "the" are intended to include the plural forms as well, unless the context clearly indicates otherwise.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

It will be understood that when an element is referred to as being "on", "coupled" or "connected" to another element, it can be directly on, coupled or connected to the other element or intervening elements may also be present. In contrast, when an element is referred to as being "directly on", "directly coupled" or "directly connected" to another element, there are no intervening elements present.

It will be understood that although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed herein could be termed a second element, component, region, layer or section without departing from the teachings of the present invention.

Spatially relative terms, such as "beneath", "below", "bottom", "lower", "above", "top", "upper" and the like, may be used herein for ease of description to describe one element's or feature's relationship to other element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly. Also, as used herein, "lateral" refers to a direction that is substantially orthogonal to a vertical direction.

Example embodiments of the present invention have been described herein with reference to cross-section illustrations that are schematic illustrations of idealized embodiments (and intermediate structures) of the invention. As such, variations from the shapes of the illustrations as a result, for example, of manufacturing techniques and/or tolerances are to be expected. Thus, embodiments of the present invention should not be construed as limited to the particular shapes of regions illustrated herein but are to include deviations in shape that result, for example, from manufacturing.

The invention claimed is:

1. A dispensing mechanism for a liquid container arranged in liquid communication with an outlet mechanism for a liquid, the dispensing mechanism comprising:

an actuation part including an actuation lever comprising a contact surface adapted to abut against the outlet mechanism; and a user lever arranged to pivot about a first pivot axis and comprising a user operated portion, wherein the dispensing mechanism is adapted to translate a user force applied to the user operated portion into a transfer force applied from the user lever to the actuation part, the actuation lever arranged to pivot about a second pivot axis, wherein a relationship between a first length and a second length forms a lever ratio, the first length extending from the first pivot axis to the user operated portion and the second length extending from the first pivot axis to a point of action of the transfer force on the actuation part, wherein the lever ratio is adapted to increase from a non-actuated position over at least the first 50% of a dispensing stroke of the actuation part such that the transfer force increases over the at least first 50% of the dispensing stroke when a constant force is applied to the user operated portion, and wherein the second pivot axis remains fixed relative to the outlet mechanism during the dispensing stroke.

2. The dispensing mechanism according to claim 1, wherein the transfer force is directed along a transfer force direction, the transfer force direction extending through a center of rotation associated with the actuation part and about which center of rotation the transfer force direction rotates as the dispensing stroke progresses.

3. The dispensing mechanism according to claim 2, wherein the point of action of the transfer force on the actuation part coincides with the center of rotation of the transfer force.

4. The dispensing mechanism according to claim 3, wherein a link part conveys the transfer force from the user lever to the actuation part.

5. The dispensing mechanism according to claim 4, wherein the link part is pivotably attached to the actuation part and arranged to pivot about the center of rotation, and wherein the point of action is at the center of rotation.

6. The dispensing mechanism according to claim 4, wherein the link part is pivotably attached to the user lever.

7. The dispensing mechanism according to claim 1, wherein the user lever comprises a first sliding surface and the actuation part comprises a second sliding surface, and wherein the first sliding surface bears in sliding abutment against the second sliding surface at an abutment point constituting the point of action to convey the transfer force from the user lever via the first sliding surface to the second sliding surface and the actuation part.

8. The dispensing mechanism according to claim 7, wherein the second sliding surface is convex.

9. The dispensing mechanism according to claim 7, wherein the first sliding surface is substantially flat.

10. The dispensing mechanism according to claim 1, wherein the dispensing mechanism is adapted for actuating the outlet mechanism comprising a hollow flexible dispensing portion and the dispensing mechanism comprises a fixed dolly adapted to abut against the hollow flexible dispensing portion, and wherein the contact surface of the actuation part is adapted to abut against the hollow flexible dispensing portion such that the hollow flexible dispensing portion is able to be arranged between the contact surface and the fixed dolly.

11. The dispensing mechanism according to claim 1, wherein the dispensing mechanism is adapted for actuating the outlet mechanism comprising a pump mechanism comprising a fixed pump part and a movable pump part arranged in slidable relation to the fixed pump part, and wherein the contact surface of the actuation part is adapted to abut against the movable pump part for actuating the movable pump part when the actuation part is subjected to the dispensing stroke.

12. The dispensing mechanism according to claim 1, wherein the first pivot axis is substantially parallel to the second pivot axis, and a first plane extends through the first pivot axis and the second pivot axis, and wherein, in a non-actuated position of the dispensing mechanism, the user operated portion of the user lever is arranged on a first side of the first plane, and wherein the user force and the transfer force are applied from the first side of the first plane at least at a beginning of the dispensing stroke of the actuation part.

13. The dispensing mechanism according to claim 12, wherein the transfer force is directed along a transfer force direction, the transfer force direction extending through a center of rotation associated with the actuation part and about which center of rotation the transfer force direction rotates as the dispensing stroke progresses, and wherein the center of rotation remains on the first side of the first plane over the dispensing stroke.

14. The dispensing mechanism according to claim 1, wherein the contact surface of the actuation part is arranged closer to a second end of the actuation part than the second pivot axis is, and wherein the first pivot axis is arranged at a first end of the user lever, and the user operated portion is arranged at a second end of the user lever.

15. The dispensing mechanism according to claim 1, wherein the actuation part is arranged to slide along a guide path during the dispensing stroke.

16. A dispenser for the liquid comprising the dispensing mechanism according to claim 1.

17. The dispenser according to claim 16, wherein the dispenser comprises a seat for receiving a disposable liquid container.

18. The dispenser according to claim 16, wherein the dispenser comprises the liquid container adapted to be refilled with the liquid.

19. The dispenser according to claim 16, wherein the dispenser comprises a hollow flexible dispensing portion.

20. The dispenser according to claim 16, wherein the dispensing mechanism is arranged at a lower end of the dispenser.

* * * * *